US006073979A

United States Patent [19]

Nawalaniec et al.

[11] Patent Number: 6,073,979

[45] Date of Patent: Jun. 13, 2000

[54] ADJUSTABLE CLAMP AND FORCE LEVEL INDICATOR FOR SCREENING MACHINE COVER

[75] Inventors: Christopher J. Nawalaniec, Cincinnati; Brady P. Ballman, Loveland, both of Ohio

[73] Assignee: Rotex, Inc., Cincinnati, Ohio

[21] Appl. No.: 08/958,904

[22] Filed: Oct. 28, 1997

[51] Int. Cl.[7] ..... B65D 45/00

[52] U.S. Cl. ..... 292/256; 292/247; 292/173; 292/DIG. 60; 209/372

[58] Field of Search ..... 209/372, 370; 292/256, 256.71, 246, 247, 66, 242, 173, DIG. 60

[56] References Cited

U.S. PATENT DOCUMENTS

| | | | |
|---|---|---|---|
| 444,077 | 1/1891 | Thompson et al. . | |
| 1,442,369 | 1/1923 | Sweet . | |
| 1,874,482 | 8/1932 | Forman . | |
| 2,079,170 | 5/1937 | Horsley . | |
| 2,370,334 | 2/1945 | Wachter . | |
| 2,410,214 | 10/1946 | Higginson et al. . | |
| 2,442,833 | 6/1948 | Watkins . | |
| 2,603,739 | 7/1952 | Steen . | |
| 2,776,854 | 1/1957 | Billstrom . | |
| 3,025,094 | 3/1962 | Buchanan . | |
| 3,433,357 | 3/1969 | Nolte . | |
| 3,497,023 | 2/1970 | Ramis . | |
| 3,954,293 | 5/1976 | Orr | 292/DIG. 49 X |
| 4,078,625 | 3/1978 | Loeb . | |
| 4,093,176 | 6/1978 | Contastin . | |
| 4,102,295 | 7/1978 | Crook, Jr. et al. . | |
| 4,184,705 | 1/1980 | Little . | |
| 4,218,081 | 8/1980 | Johnson | 292/DIG. 49 X |
| 4,230,023 | 10/1980 | Ward . | |
| 4,307,906 | 12/1981 | Schenk | 292/247 |
| 4,454,831 | 6/1984 | Gallo . | |
| 4,540,206 | 9/1985 | Frame et al. | 292/66 |
| 4,583,442 | 4/1986 | Minor | 292/DIG. 49 X |
| 4,622,902 | 11/1986 | Miller . | |
| 4,657,062 | 4/1987 | Tuerk | 292/247 X |
| 5,011,200 | 4/1991 | Glancy | 292/DIG. 60 X |
| 5,150,796 | 9/1992 | Pierson . | |
| 5,287,602 | 2/1994 | Dykstra | 292/DIG. 49 X |
| 5,478,125 | 12/1995 | Gromotka | 292/DIG. 49 X |

*Primary Examiner*—B. Dayoan
*Assistant Examiner*—Clifford B Vaterlaus
*Attorney, Agent, or Firm*—Wood, Herron & Evans, L.L.P.

[57] ABSTRACT

A clamp for securing a removable cover on a screening machine is an over-center mechanical clamp which includes two distinct clamping force adjustment mechanisms. A first clamping force adjustment mechanism includes a plurality of clamping positions on a support bracket mounted on the cover. The clamp handle assembly is selectively positioned in one of the clamping positions on the support bracket to provide incrementally different clamping force levels. Additionally, irrespective of the clamping position, rotation of a threaded rod of the clamp adjusts the clamping force. A force level indicator is provided on the clamp to indicate the clamping force produced by the clamp.

19 Claims, 4 Drawing Sheets

ADJUSTABLE CLAMP AND FORCE LEVEL INDICATOR FOR SCREENING MACHINE COVER

BACKGROUND OF THE INVENTION

This invention relates to clamping devices for use with machinery of the type used to sift, screen, size or separate particulate material, which machines are generically referred to herein as "screening machines".

Screening machines commonly have one or more screens which are mounted in sloping planes within a screen frame or screen box, and the material to be separated is discharged onto the screens. Vibratory motion, reciprocating motion, gyratory motion or combinations thereof are imparted to each screen to shake the material and permit the finer particles to fall through the screen openings while the courser material remains on top of the screen. Such machines are commonly provided with a top cover which encloses the screen assembly. This top cover is releasably clamped to the screen frame or screen box.

The cover encloses the material being screened, preventing it from being shaken off the screen and minimizes dust generated in the screening process which may escape from the screen box. From time to time it is necessary to remove the cover, for instance to change or replace the screen. Because the frame and screen are shaken with substantial force in operation, the cover is typically clamped to the frame for movement with it. The particulate matter to be screened is fed through an inlet chute in the cover which discharges it onto the screen.

Various forms of cover hold-down clamps have been proposed specifically for use on screening machines, including manually operated over-center hold-down clamps, for example the type shown in Nolte, U.S. Pat. No. 3,433,357. In the use of such clamps, a clamp arm is manually engaged with the cover or frame or other member to be clamped and an arm is pulled from one side of a center position to the other side, so as to draw together the two members to be clamped. The standard mechanical clamp is an over-center cam that contains a rigid, threaded rod. This clamp can provide a high clamping force and is a relatively simple design. Such manual clamps provide a strong, non-compensating clamping force.

To provide an approximately uniform clamping force among the several clamps around the periphery of the frame (so that the cover is not held too tightly in one area and too loosely at another), each clamp must be manually adjusted by rotation of the threaded rod to provide roughly the same mechanical clamping force. In a large screening machine there may be as many as 20 or more clamps around the frame. When several such clamps must all be set and adjusted uniformly, it often happens that the force of the earlier set clamps is changed by the later set clamps so that it is necessary to go back and readjust the earlier set clamps. Such individual and repetitive adjustment requires substantial time and effort. Moreover, the threaded rods of such clamps over time become clogged with dust from the material being screened and tend to gall or seize so that they cannot be easily turned and adjusted.

Additionally, when setting mechanical clamps on a screening machine, it is difficult for an operator to set the appropriate clamping force for each of the clamps. Commonly, the operator adjusts the clamp so that it provides the maximum possible clamping force which may result in damage to the equipment. Additionally, to release the clamp when set in this manner, it is often very difficult and may require a pry bar or other mechanical assist and, when the clamp is open, the released force may prove harmful to the operator.

In some applications, screening machines are subjected to substantial heat during use, as for example when a hot material is being screened. Thermal expansion of the frame and/or cover caused by such heat puts a substantial load on the mechanical clamp making it difficult to operate. In some circumstances, the force of thermal expansion on a tightly sealed clamp can even warp or deform the machine components. However, due to the stiff rod, this clamp design provides poor maintenance of clamping force due to dimensional changes associated with temperature, seal setting or configuration between the screen box and the cover and tolerance stack-up such as wear and tear on the equipment.

Another type of clamp which has been used with screening machines is disclosed in Pierson, U.S. Pat. No. 5,150,796 assigned to the assignee of this invention. That patent discloses a clamp which is air pressure operated, both when applying clamping force and to retract or swing the clamp away from a clamping position when it is open. Super-atmospheric pressure is applied to the clamp for clamping and sub-atmospheric pressure is applied to swing the clamp away. This clamp utilizes a pneumatic air stroke actuator that is inflated to hold down the cover.

Advantages of this type of clamp include the avoidance of over clamping which is common with the standard mechanical over-center type of clamp. Additionally, the pneumatic clamp is very compensating to dimensional changes resulting from temperature or other variations while providing consistent clamping force when inflated. Additionally, the pneumatic clamp requires an external air supply unlike standard mechanical clamps. Moreover, the clamping force provided by a pneumatic clamp is more limited than that available from a mechanical clamp. Furthermore, the pneumatic clamps cannot optimally be used in certain environments or with particularly corrosive, or other caustic materials.

SUMMARY OF THE INVENTION

A new clamp design to releasably secure a cover on a screening machine has been developed that offers the advantages of both standard mechanical clamps and pneumatic clamps while avoiding the drawbacks of each. The clamp according to the presently preferred embodiment of the invention releasably secures the cover to the screen box and includes a support bracket mounted on the cover. The bracket is designed with different clamping positions or pockets. The support bracket is engaged by a toggle assembly which is pivotally mounted on the screen box and includes a compression spring contained within a saddle bracket and having a threaded rod projecting longitudinally through the compression spring and out of the top of the saddle bracket. Pivotally attached to an upper end of the rod is a clamp handle having a fulcrum bar fixed thereon. In operation, the clamp operates similar to a standard mechanical over-center clamp to secure the cover to the screen box.

The clamping force of an over-center type clamp is typically a function of the distance from the center line of a hinge pin of the clamp to the center line of the clamp handle or fulcrum bar. The position of the fulcrum bar of the clamp of this invention relative to a hinge pin which pivotally mounts the toggle mechanism to the screen box can be selectively adjusted by using one or both of two adjustment mechanisms. A first adjustment mechanism includes the multiple clamping positions on the support bracket.

Specifically, the distance between the clamping position for the fulcrum bar and the hinge pin can be incrementally adjusted by selecting specific rest positions for the fulcrum bar on the support bracket. For example, in one presently preferred embodiment, an incremental height change between each of the clamping positions is 0.05" for an approximate plus or minus 100 lbs. of clamping force adjustment.

Additionally, a secondary clamping force adjustment mechanism includes turning the clamp about the threaded rod and thereby selectively raising or lowering the clamping force by repositioning a threaded member relative to the rod to change the overall length of the toggle assembly.

The spring in the toggle assembly advantageously offers a compensating feature to the clamp of this invention. The spring or other biasing member compensates for dimensional changes in the parts of the clamp which may result from temperature changes or prolonged use of the clamp to provide a consistent clamping force when the clamp is appropriately set. Known mechanical clamps for screening machines do not offer this advantage due to the stiff threaded rod without a biasing member.

Another important aspect of a screening machine clamp according to a presently preferred embodiment of this invention is a force level indicator on each of the clamps. The force level indicator provides the user of the screening machine an indication of the appropriate clamping force for securing the cover on the screen box. The force level is indicated by the position of an indicator plate relative to a reference on the saddle bracket. The indicator plate travels along with the compression of the spring and includes an arm projecting toward the saddle bracket which includes a reference scale or indication of the appropriate clamping force.

Advantageously, the clamp of this invention can be retrofitted on screening machines previously provided with a standard mechanical clamp to utilize much of the existing hardware on the machine. The advantages of the clamp of this invention include vastly improved compensation for dimensional changes with minor loss or gain in clamping force, no outside power source requirement such as an airline or the like, more consistent clamping force, less application sensitive compared to the pneumatic clamps and the ability to gauge the actual clamping force from a visual indicator. Additionally, the present invention provides a smoother, easier feel for the user during clamping due to the linear force increase through the clamp travel as compared to the stiff rod tension of the standard over-center mechanical clamp.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
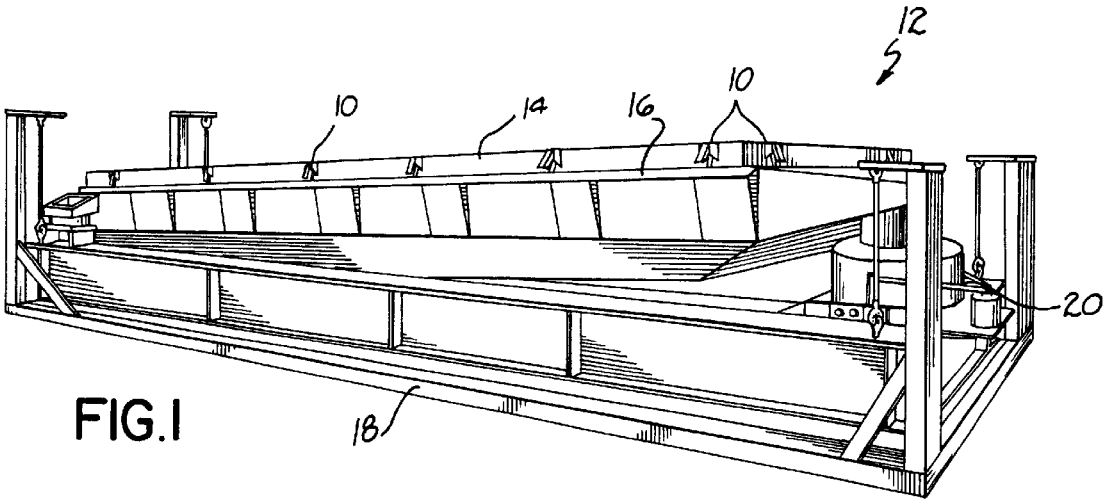
FIG. 1 is a perspective view showing one illustrative type of a commercial screening machine with which the clamps of this invention may be used.

Referring to FIG. 1, a presently preferred embodiment of a plurality of clamps 10 in use on a screening machine 12 is shown. The screening machine 12 includes a top cover 14 which is clamped onto a screen box 16 of the screening machine 12. Screening machines of this general type are sold commercially, one example being the "Rotex" screeners made and sold by the assignee of this invention, Rotex, Inc. of Cincinnati, Ohio. A series of clamps 10 are mounted around the screen box 16 and are engagable with the top cover 14 to clamp the cover 14 to it. (It will be appreciated that alternatively the clamps 10 could be mounted to the cover 14 to clamp to the screen box 16.) The machine 12 includes a base 18 and the screen box 16 within which may be mounted one or more parallel screens (not shown) of graduated mesh sizes. At its upper end or head, the screen box 16 is driven by an electric motor (not shown) through an eccentric or other screening motion creating mechanism 20 which imparts an oscillatory, gyrotary, or rotary motion to the screen box 16.

The cover 14 is typically steel or aluminum and completely encloses the screen(s) within it to prevent the material being screened from contamination by extraneous matter and to minimize the escape of dust and finer material from the screen box 16. A gasket or other type of seal (not shown) may be provided between the cover 14 and the screen box 16. The material to be screened is charged onto the upper end of the screen in the screen box 16 through a chute (not shown) which passes through an opening (not shown) in the top cover 14. As is well known, when the machine 12 is operated, the particulate material entering through the chute moves generally in the downward direction along the length of the screen in the box 16 with the finer material passing through the screen.

One of the clamps 10 according to a presently preferred embodiment of this invention is shown in detail in FIGS. 2–4C. The clamp 10 includes a toggle assembly 22 mounted on the screen box 16. The toggle assembly 22 is coupled to a support bracket 24 mounted on the cover 14. It will be appreciated by one of ordinary skill in the art that, alternatively, the toggle assembly 22 may be mounted to the cover 14 and the support bracket 24 mounted on the screen box 16 according to this invention.

The support bracket 24 is preferably steel, generally U-shaped and includes a pair of spaced arms 26 projecting generally perpendicularly to a surface of the cover 14. A plurality of generally semi-circular spaced pockets 28 are provided on an upper edge of each of the arms 26. Aligned pockets on the spaced arms 26 cooperate to form a plurality of clamping positions in which each clamping position provides a different clamping force depending upon which position is engaged by the toggle assembly 22.

Figure 3:
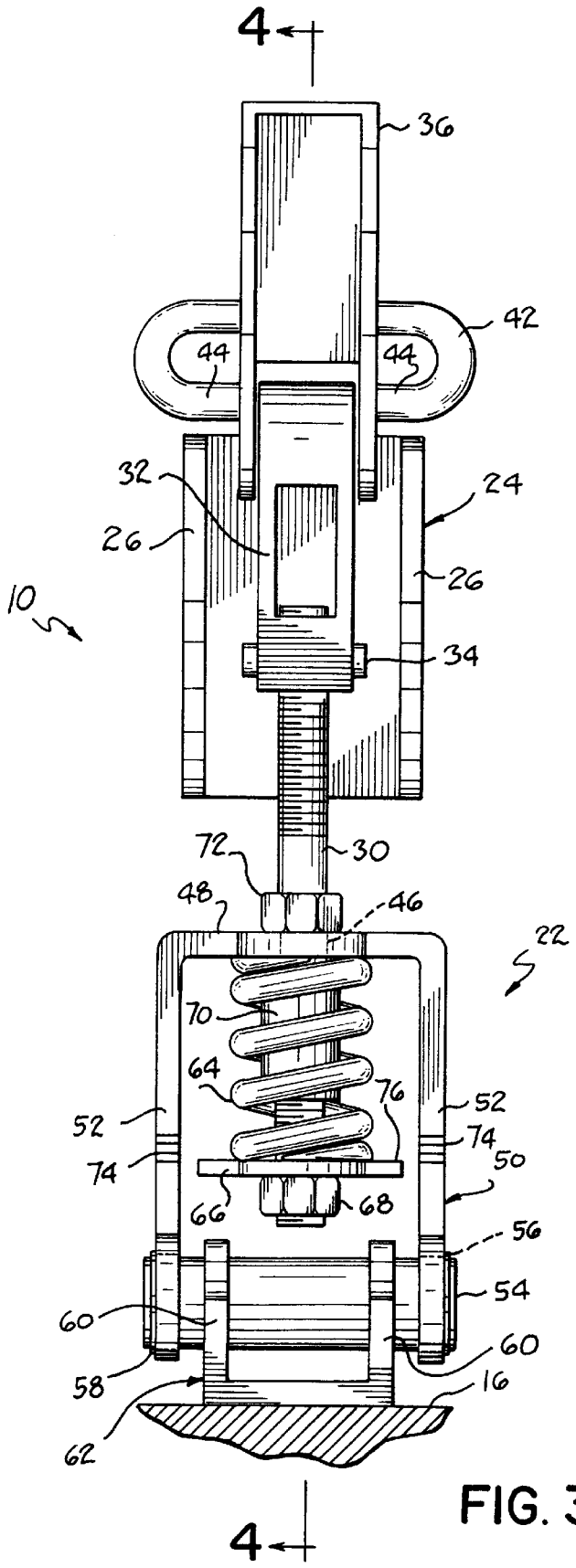
FIG. 3 is a front elevational view of the toggle assembly, handle assembly and support bracket in an open position of the clamp.

The toggle assembly 22 includes a threaded preferably stainless steel rod 30 having an upper end which is threadably received in a threaded aperture (not shown) of a link 32 (FIG. 3). The link 32 is preferably cast stainless steel. A pair of dent studs 34 project outwardly from opposite side faces of the link 32, the purposes of which will be described later herein below. In a presently preferred embodiment of the invention, the threaded rod 30 may be anywhere from 2 ½" in length to 14 ⅝" or longer in length. The threaded rod 30 and link 32 comprise a shaft assembly.

Figure 2:
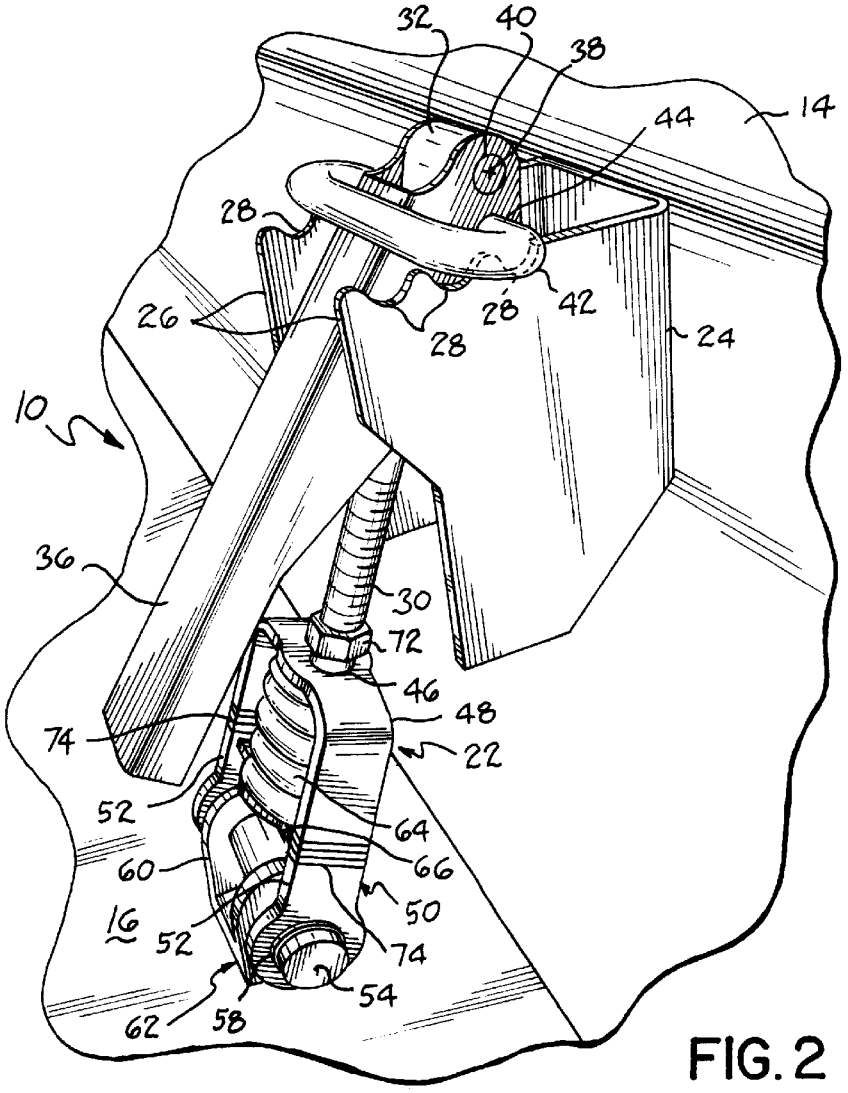
FIG. 2 is an enlarged perspective view of the clamp in the clamped position releasably securing a cover on the screen box of the screening machine of FIG. 1.

A handle assembly, preferably stainless steel, is pivotally connected to an upper end of the link 32 by a pivot pin 38 which projects through a hole 40 in the link 32 and into the opposing arms of a generally U-shaped handle 36. An oval shaped fulcrum bar 42 is fixedly mounted on the handle 36 proximate the pivot pin 38. The handle 36 and fulcrum bar 42 are each preferably stainless steel. The plane of the oval shaped fulcrum bar 42 is generally perpendicular to the longitudinal axis of the handle 36. Opposing shoulders 44 on the fulcrum bar 42 are sized and configured to rest in the aligned pockets 28 on the upper edge of the spaced support bracket arms 26 when the clamp 10 is in a clamping position as shown in FIG. 2. The shoulders 44 on the fulcrum bar 42 may be positioned within any pair of the aligned pockets 28 to provide different clamping positions for the handle assembly and thereby provide incremental clamping force changes. The detent studs 34 are positioned to limit the movement of the handle 36 in the clamped position as shown in FIG. 2.

A lower portion of the threaded rod 30 projects through a hole 46 in a bight 48 of a U-shaped saddle bracket 50. A pair of spaced legs 52 project from the bight 48 of the saddle bracket 50 and are pivotally mounted on a hinge pin 54. The saddle bracket 50 and hinge pin 54 are preferably each stainless steel. A groove 56 is provided proximate each end of the hinge pin 54 to receive therein a snap ring 58, preferably mild steel, to secure the legs 52 of the saddle bracket 50 onto the hinge pin 54. The hinge pin 54 also extends through the upward extending spaced arms 60 of a stainless steel clevis mount 62 which is mounted on an upper, generally planar surface of the screen box 16. The hinge pin 54, saddle bracket 50 and clevis mount 62 cooperate to pivotally mount the toggle assembly 22 onto the screen box 16.

A biasing member 64 such as a spiral compression spring, bellville washer or the like is positioned around the portion of the threaded rod 30 projecting into the saddle bracket 50 and between the bight 48 and an indicator plate 66 mounted proximate an end of the threaded rod. The spring 64 is preferably chrome vanadium which has been nickel plated to extend its service life and shot peened to reduce internal stresses. This spring 64 and indicator plate 66 are retained on the threaded rod 30 by a threaded nut 68 or the like. A tubular shaped stainless steel bushing 70 is preferably mounted on the threaded rod 30 inside of the compression spring 64 and the saddle bracket 50 as shown particularly in FIGS. 3–4C. A nut 72 is threadably mounted on the threaded rod 30 on top of the bight 48 of the saddle bracket 50. The nuts 68, 72 are preferably nickel plated steel and the indicator plate 66 is preferably stainless steel.

Reference markings 74 such as notches, a graduated scale or the like are preferably provided on the front and back edges of the legs 52 of the saddle bracket 50 and the indicator plate 66 includes a pointer 76 which is calibrated relative to the reference markings 74 to indicate the clamping force applied by the clamp 10. The clamp 10 may include a thin gauge metal shield or rubber molded boot (not shown) surrounding the biasing member 64 to protect it from dust or other environmental factors. The length of the bushing 70 limits the travel of the indicator plate 66 and the compression of the spring 64 within the saddle bracket 50 and is designed for application specific configurations such that only the maximum allowable compression of the spring 64 would be possible. In one presently preferred embodiment, the spring 64 has been designed to provide up to and perhaps over 1,000 lbs. of clamping force.

Figure 4A:
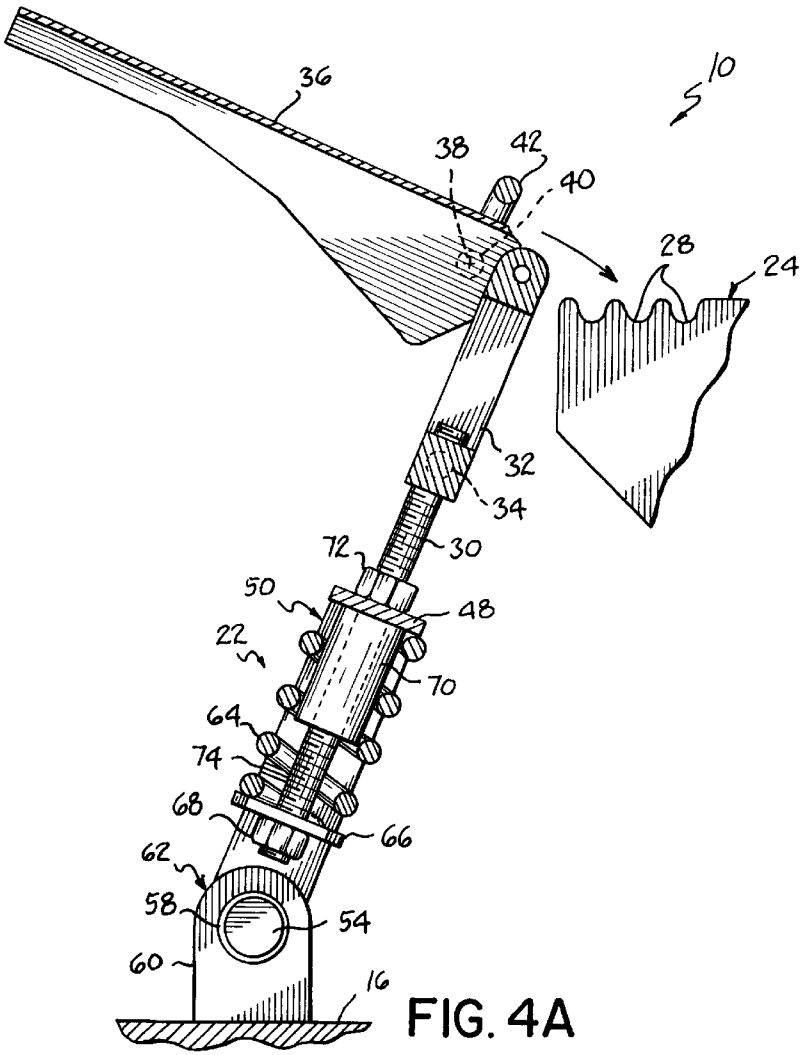
FIG. 4A is a cross-sectional side elevational view along line 4—4 of FIG. 3.
Figure 4B:
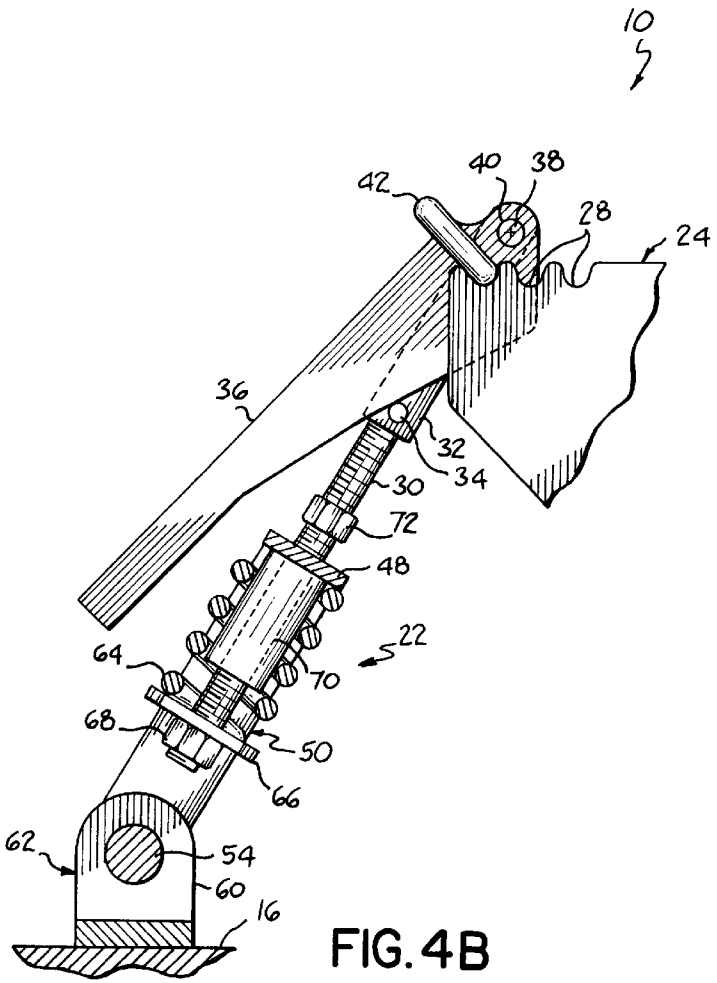
FIG. 4B is similar to FIG. 4A with the clamp secured in a first clamping position.
Figure 4C:
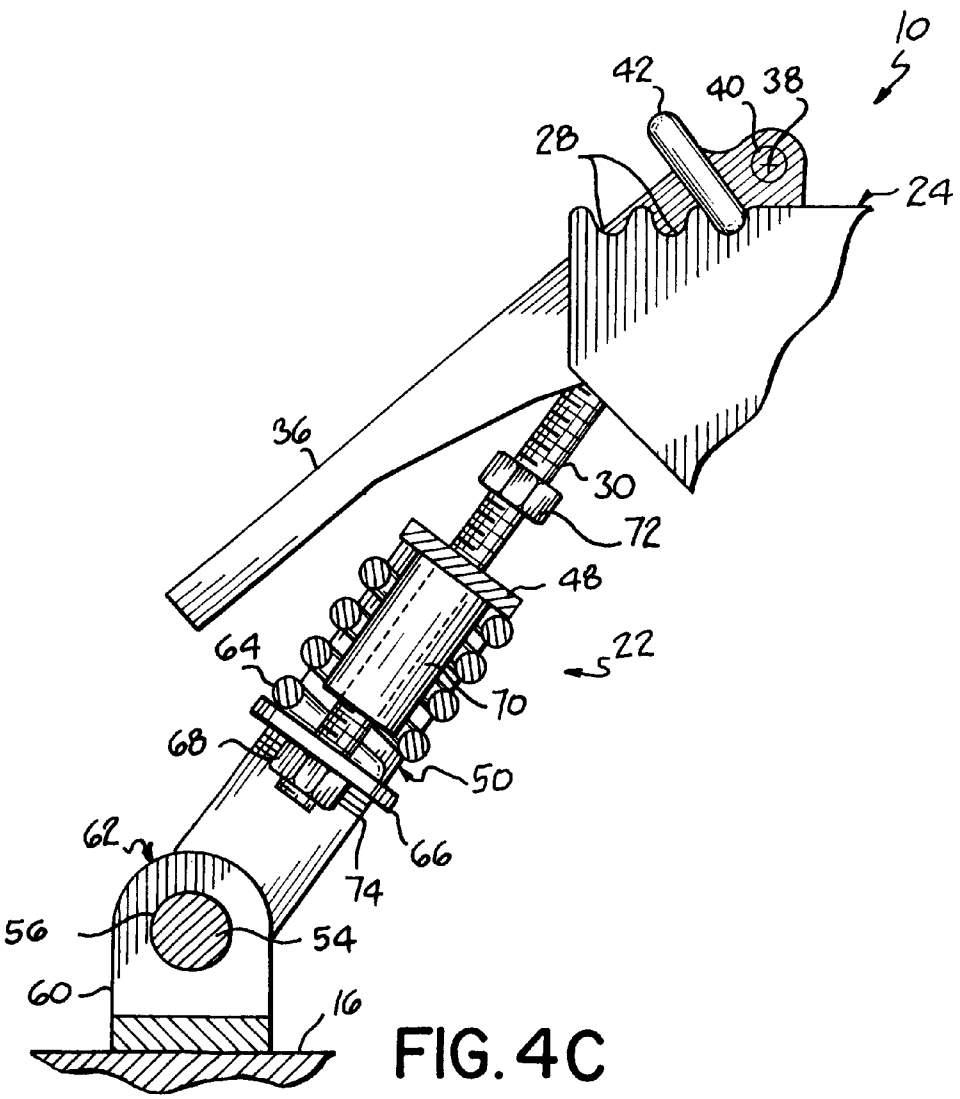
FIG. 4C is a view similar to FIG. 4B with the clamp in an alternative clamping position to provide a different clamping force.

The clamping force is a function of the distance from the center line of the hinge pin 54 to the center line of the shoulders 44 of the fulcrum bar 42. Without adjusting the position of the clamp handle 36 by turning the clamp handle 36 about the threaded rod 30 and adjusting the position of the link 32 relative to the threaded rod 30, different clamping positions can be selected thereby raising or lowering the clamping force. In this manner, two distinct clamping force adjustment mechanisms are provided with this invention. The incremental clamping force adjustment associated with the discrete clamping positions on the support bracket 24 is achieved by selecting each of the different pockets 28 on the support bracket 24 for engagement with the fulcrum bar 42 of the handle assembly. For example, each of the adjacent clamping position pockets 28 in a presently preferred embodiment of the invention represents a difference of 0.05" in height between the hinge pin 54 and the fulcrum bar shoulder 44 thereby resulting in an approximate plus or minus 100 lbs. clamping force with a biasing member 64 having a spring constant approximately equal to 2,100 lbs. per inch. Specifically, the clamping position pockets 28 spaced farthest away from the cover 14 as shown in FIG. 4B provide the lowest clamping force of the clamping positions; whereas, the clamping position pockets 28 closest to the cover as shown in FIG. 4C provide the highest clamping force. Additionally, a secondary clamping force adjustment mechanism is available by rotation of the threaded link 32 relative to the threaded rod 30 lengthens or shortens the toggle assembly 22 irrespective of the clamping position engaged on the support bracket 24.

Advantageously, the screening machine clamp 10 of this invention may be a retrofit item for current mechanical clamps or can be provided as original equipment with a screening machine.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A screening machine having a screen box and a removable cover releasably secured to the screen box by a plurality of clamps, each of the clamps comprising:

a toggle assembly mounted to one of the cover and the screen box;

a support bracket mounted to the other of the cover and the screen box;

a plurality of spaced clamping positions on the support bracket each of which is adapted to receive and hold a portion of the toggle assembly, the toggle assembly engaging the support bracket at one of the plurality of clamping positions to thereby releasably secure the cover to the screen box, whereby the clamp provides a different clamping force corresponding to the different clamping positions engageable by the toggle assembly;

a secondary clamping force adjustment mechanism which provides for adjustment of the clamping force of the clamp irrespective of which of the clamping positions is engaged by the toggle mechanism.

2. The screening machine of claim 1 wherein the support bracket is mounted on the cover and the toggle assembly is pivotally mounted on the screen box.

3. The screening machine of claim 1 wherein the toggle assembly comprises:

a shaft assembly; and a handle pivotally coupled to the shaft so that the clamp is an over-center clamp when engaged with the support bracket.

4. The screening machine of claim 3 further comprising:

a fulcrum bar fixed to the handle and being sized and configured to engage each of the clamping positions on the support bracket.

5. The screening machine of claim 3 wherein the shaft assembly is pivotally mounted on the screen box and further comprises:

a threaded rod;

a saddle bracket having a pair of legs, each of the legs projecting from a bight of the saddle bracket, a portion of the threaded rod projecting through a hole in the bight; and a biasing member coupled to the threaded rod and the saddle bracket.

6. The screening machine of claim 5 wherein rotation of the threaded rod relative to a mating threaded member adjusts a length of the shaft assembly and thereby the clamping force via the secondary clamping force adjustment mechanism.

7. The screening machine of claim 1 further comprising:

a clamping force indicator on the toggle assembly which displays the clamping force of the clamp.

8. The screening machine of claim 5 further comprising:

a clamping force indicator which displays the clamping force of the clamp, the clamping force indicator being mounted on the portion of the threaded rod and on an end of the biasing member opposite from the bight of the saddle bracket.

9. An apparatus comprising:

a screening machine having a screen box;

a screen mounted in the screen box;

a removable cover releasably secured to the screen box; a plurality of clamps releasably securing the cover on the screen box, each of the clamps comprising:

(a) a toggle assembly mounted to one of the cover and the screen box;

(b) a support bracket mounted to the other of the cover and the screen box;

(c) a plurality of clamping positions on the support bracket each of which is adapted to receive and hold a portion of the toggle assembly, the toggle assembly engaging the support bracket at one of the plurality of clamping positions to thereby releasably secure the cover to the screen box, whereby the clamp provides a different clamping force corresponding to the different clamping positions engageable by the toggle assembly; and a secondary clamping force adjustment mechanism which provides for adjustment of the clamping force of the clamp irrespective of which of the clamping positions is engaged by the toggle mechanism.

10. The apparatus of claim 9 further comprising:

a clamping force indicator on the toggle assembly which displays the clamping force of the clamp.

11. A screening machine having a screen box and a removable cover releasably secured to the screen box by a plurality of clamps, each of the clamps comprising:

a shaft assembly pivotally mounted on the screen box via a saddle bracket, the saddle bracket having a pair of legs, each of the legs projecting from a bight of the saddle bracket, the shaft assembly including a threaded rod projecting through a hole in the bight and a biasing member coupled to the threaded rod and the saddle bracket;

a handle pivotally coupled to the shaft assembly;

a fulcrum bar fixed to the handle;

a support bracket mounted to the cover;

a plurality of clamping positions on the support bracket, the fulcrum bar engaging the support bracket at one of the plurality of clamping positions on the support bracket to thereby releasably secure the cover to the screen box, whereby the clamp provides a different clamping force corresponding to the different clamping positions engageable by the toggle assembly; and a secondary clamping force adjustment mechanism which provides for selective adjustment of the clamping force of the clamp irrespective of which of the clamping positions is engaged by the fulcrum, wherein rotation of the threaded rod relative to a mating threaded member adjusts a length of the shaft assembly and thereby the clamping force.

12. The screening machine of claim 11 further comprising:

a clamping force indicator which displays the clamping force of the clamp, the clamping force indicator being mounted on a portion of the threaded rod at an end of the biasing member opposite from the bight of the saddle bracket.

13. A screening machine having a screen box and a removable cover releasably secured to the screen box by a plurality of clamps, each of the clamps comprising:

a toggle assembly mounted to the screen box;

a support bracket mounted to the cover, the toggle assembly engaging the support bracket to thereby releasably secure the cover to the screen box;

wherein the toggle assembly includes a shaft assembly and a handle pivotally coupled to the shaft so that the clamp is an over-center clamp when engaged with the support bracket;

a clamping force indicator which displays the clamping force of the clamp;

wherein the shaft assembly further comprises:

a threaded rod;

a saddle bracket having a pair of legs, each of the legs projecting from a bight of the saddle bracket, a portion of the threaded rod projecting through a hole in the bight; and a biasing member coupled to the threaded rod and the saddle bracket;

wherein the clamping force indicator measures a position of the biasing member relative to a reference.

14. The screening machine of claim 13 wherein the clamping force indicator is mounted on the portion of the threaded rod and on an end of the biasing member opposite from the bight of the saddle bracket.

15. A screening machine having a screen box and a removable cover releasably secured to the screen box by a plurality of clamps, each of the clamps comprising:

a toggle assembly mounted to one of the cover and the screen box;

a support bracket mounted to the other of the cover and the screen box, the toggle assembly engaging the support bracket to thereby releasably secure the cover to the screen box;

a clamping force indicator which displays the clamping force of the clamp; and a first clamping force adjustment mechanism which provides for selective adjustment of the clamping force of the clamp;

wherein the first clamping force adjustment mechanism includes a plurality of clamping positions on the support bracket, whereby the clamp provides a different clamping force corresponding to the different clamping positions engageable by the toggle assembly;

wherein the toggle assembly, support bracket and plurality of clamping positions combine to provide discrete incremental clamping force adjustment for the clamp;

a secondary clamping force adjustment mechanism which provides for selective adjustment of the clamping force of the clamp irrespective of which of the clamping positions is engaged by the toggle mechanism.

16. An apparatus comprising:

a screening machine having a screen box;

a screen mounted in the screen box;

a removable cover releasably secured to the screen box; and a plurality of clamps releasably securing the cover on the screen box, each of the clamps comprising:

(a) a toggle assembly mounted to one of the cover and the screen box;

(b) a support bracket mounted to the other of the cover and the screen box, the toggle assembly engaging the support bracket to thereby releasably secure the cover to the screen box;

(c) a clamping force indicator on the toggle assembly which displays the clamping force of the clamp;

(d) a first clamping force adjustment mechanism which provides for selective adjustment of the clamping force of the clamp, wherein the first clamping force adjustment mechanism includes a plurality of clamping positions on the support bracket, whereby the clamp provides a different clamping force corresponding to the different clamping positions engageable by the toggle assembly;

wherein the toggle assembly, support bracket and plurality of clamping positions combine to provide discrete incremental clamping force adjustment for the clamp; and (f) a secondary clamping force adjustment mechanism which provides for selective adjustment of the clamping force of the clamp irrespective of which of the clamping positions is engaged by the toggle mechanism.

17. A screening machine having a screen box and a removable cover releasably secured to the screen box by a plurality of clamps, each of the clamps comprising:

a shaft assembly pivotally mounted on the screen box via a saddle bracket, the saddle bracket having a pair of legs, each of the legs projecting from a bight of the saddle bracket, the shaft assembly including a threaded rod projecting through a hole in the bight and a biasing member coupled to the threaded rod and the saddle bracket;

a handle pivotally coupled to the shaft assembly;

a fulcrum bar fixed to the handle;

a support bracket mounted to the cover, the fulcrum bar engaging the support bracket at a clamping position on the support bracket to thereby releasably secure the cover to the screen box; and a clamping force indicator which displays the clamping force of the clamp, the clamping force indicator being mounted on a portion of the threaded at an end of the biasing member opposite from the bight of the saddle bracket, wherein the clamping force indicator measures a position of the biasing member relative to a reference.

18. The screening machine of claim 1 wherein the toggle assembly further comprises a biasing member coupled thereto, the biasing member being the secondary clamping force adjustment mechanism.

19. The apparatus of claim 9 wherein the toggle assembly further comprises a biasing member coupled thereto, the biasing member being the secondary clamping force adjustment mechanism.

* * * * *